US007238885B2

(12) United States Patent
Lique et al.

(10) Patent No.: US 7,238,885 B2
(45) **Date of Patent: *Jul. 3, 2007**

(54) REDUCED ALIEN CROSSTALK ELECTRICAL CABLE WITH FILLER ELEMENT

(75) Inventors: Roger Lique, Standford, KY (US); Asef Baddar, Independence, KY (US); Thomas McLaughlin, Taylor Mill, KY (US); Mike Doorhy, Mokena, IL (US); David Hawkins, Sugar Hill, GA (US)

(73) Assignees: Panduit Corp., Tinley Park, IL (US); General Cable Technology Corp., Highland Heights, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/087,571

(22) Filed: Mar. 24, 2005

(65) Prior Publication Data

US 2006/0131057 A1 Jun. 22, 2006

Related U.S. Application Data

(63) Continuation-in-part of application No. 11/012,167, filed on Dec. 16, 2004, now Pat. No. 7,157,644.

(51) Int. Cl.
*H01B 7/00* (2006.01)

(52) U.S. Cl. ..... 174/113 C

(58) Field of Classification Search ..... 174/113 R, 174/113 C, 131 A, 116, 27
See application file for complete search history.

(56) References Cited

U.S. PATENT DOCUMENTS

| | | | |
|---|---|---|---|
| 483,285 | A | 9/1892 | Guilleaume |
| 1,008,370 | A | 11/1911 | Robillot |
| 1,654,508 | A | 12/1927 | Boggs |
| 1,673,752 | A | 6/1928 | Lewis et al. |
| 1,739,012 | A | 12/1929 | Middleton |
| 1,780,564 | A | 11/1930 | Oxer |
| 1,883,269 | A | 10/1932 | Yonkers |
| 1,976,847 | A | 10/1934 | Gordon et al. |
| 2,125,869 | A | 8/1938 | Atkinson |
| 2,455,773 | A | 12/1948 | Johnson |
| 2,538,019 | A | 1/1951 | Lee |
| 2,583,026 | A | 1/1952 | Swift |

(Continued)

FOREIGN PATENT DOCUMENTS

| | | |
|---|---|---|
| EP | 0 302 162 | 4/1995 |

(Continued)

*Primary Examiner*—Chau N. Nguyen
(74) *Attorney, Agent, or Firm*—Blank Rome LLP

(57) ABSTRACT

An electrical cable includes a cable jacket defining a central longitudinal axis and a plurality of twisted pairs of insulated conductors oriented longitudinally within the cable jacket. Each of the twisted pairs of insulated conductors has a width. A filler element is disposed in the cable jacket and is located adjacent to at least one of the twisted pairs of insulated conductors. The filler element defines a width that is substantially larger than the width of each the twisted pairs of insulated conductors. The filler element has a central axis laterally offset from the central longitudinal axis of the cable jacket. The filler element reduces alien crosstalk from an adjacent cable. A separator is disposed in said cable jacket between the twisted pairs of insulated conductors to reduce crosstalk between the twisted pairs of insulated conductors.

38 Claims, 4 Drawing Sheets

U.S. PATENT DOCUMENTS

| | | | | |
|---|---|---|---|---|
| RE24,154 | E | 5/1956 | Krueger | |
| 2,804,494 | A | 9/1957 | Fenton | |
| 2,847,499 | A | 8/1958 | Peterson | |
| 3,005,739 | A | 10/1961 | Lang et al. | |
| 3,032,604 | A | 5/1962 | Timmons | |
| 3,086,557 | A | 4/1963 | Peterson | |
| 3,102,160 | A | 8/1963 | Cook et al. | |
| 3,131,469 | A | 5/1964 | Glaze | |
| 3,209,064 | A | 9/1965 | Cutler | |
| 3,234,722 | A | 2/1966 | Gilmore | |
| 3,263,024 | A | 7/1966 | Hirsch | |
| 3,274,329 | A | 9/1966 | Timmons | |
| 3,324,233 | A | 6/1967 | Bryant | |
| 3,622,683 | A | 11/1971 | Roberts et al. | |
| 3,644,659 | A | 2/1972 | Campbell | |
| 3,649,434 | A | 3/1972 | Mortenson | |
| 3,649,744 | A | 3/1972 | Coleman | |
| 3,650,862 | A | 3/1972 | Burr | |
| 3,678,177 | A | 7/1972 | Lawrenson | |
| 3,715,458 | A | 2/1973 | Bayes et al. | |
| 3,761,842 | A | 9/1973 | Gandrud | |
| 3,803,340 | A | 4/1974 | Jachimowiczm et al. | |
| 3,843,831 | A | 10/1974 | Hutchison et al. | |
| 3,881,052 | A | 4/1975 | Britz et al. | |
| 3,911,200 | A | 10/1975 | Simons et al. | |
| 3,921,381 | A | 11/1975 | Vogelsberg | |
| 4,010,213 | A | 3/1977 | Naegeli | |
| 4,034,148 | A | 7/1977 | Lang | |
| 4,041,237 | A | 8/1977 | Stine et al. | |
| 4,081,602 | A | 3/1978 | Paniri et al. | |
| 4,085,284 | A | 4/1978 | Olszewski et al. | |
| 4,096,346 | A | 6/1978 | Stine et al. | |
| 4,110,554 | A | 8/1978 | Moore et al. | |
| 4,131,690 | A | 12/1978 | Jukes et al. | |
| 4,165,442 | A | 8/1979 | Gabriel et al. | |
| 4,218,581 | A | 8/1980 | Suzuki | |
| 4,234,759 | A | 11/1980 | Harlow | |
| 4,262,164 | A | 4/1981 | Nutt et al. | |
| 4,319,940 | A | 3/1982 | Arroyo et al. | |
| 4,340,771 | A | 7/1982 | Watts | |
| 4,356,345 | A | 10/1982 | Gonia | |
| 4,368,214 | A | 1/1983 | Gillette | |
| 4,393,582 | A | 7/1983 | Arnold, Jr. et al. | |
| 4,394,705 | A | 7/1983 | Blachman | |
| 4,404,424 | A | 9/1983 | King et al. | |
| 4,412,094 | A | 10/1983 | Dougherty et al. | |
| 4,449,012 | A | 5/1984 | Voser | |
| 4,453,031 | A | 6/1984 | Justiss | |
| 4,467,138 | A | 8/1984 | Brorein | |
| 4,468,089 | A | 8/1984 | Brorein | |
| 4,481,379 | A | 11/1984 | Bolick, Jr. et al. | |
| 4,486,619 | A | 12/1984 | Trine et al. | |
| 4,487,992 | A | 12/1984 | Tomita | |
| 4,500,748 | A | 2/1985 | Klein | |
| 4,515,993 | A | 5/1985 | MacKenzie | |
| 4,541,980 | A | 9/1985 | Kiersarsky et al. | |
| 4,550,559 | A | 11/1985 | Thomson | |
| 4,552,432 | A | 11/1985 | Anderson et al. | |
| 4,588,852 | A | 5/1986 | Fetterolf et al. | |
| 4,595,793 | A | 6/1986 | Arroyo et al. | |
| 4,605,818 | A | 8/1986 | Arroyo et al. | |
| 4,697,051 | A | 9/1987 | Beggs et al. | |
| 4,711,811 | A | 12/1987 | Randa | |
| 4,755,629 | A | 7/1988 | Beggs et al. | |
| 4,767,890 | A | 8/1988 | Magnan | |
| 4,777,325 | A | 10/1988 | Siwinski | |
| 4,800,236 | A | 1/1989 | Lemke | |
| 4,873,393 | A | 10/1989 | Friesen et al. | |
| 4,933,513 | A | 6/1990 | Lee | |
| 4,941,729 | A | 7/1990 | Hardin et al. | |
| 4,963,609 | A | 10/1990 | Anderson et al. | |
| 5,010,210 | A | 4/1991 | Sidi et al. | |
| 5,015,800 | A | 5/1991 | Vaupotic et al. | |
| 5,103,067 | A | 4/1992 | Aldissi | |
| 5,110,999 | A | 5/1992 | Barbera | |
| 5,132,488 | A | 7/1992 | Tessier et al. | |
| 5,142,100 | A | 8/1992 | Vaupotic | |
| 5,162,609 | A | 11/1992 | Adriaenssens et al. | |
| 5,202,946 | A | 4/1993 | Hardin et al. | |
| 5,245,134 | A | 9/1993 | Vana, Jr. et al. | |
| 5,253,317 | A | 10/1993 | Allen et al. | |
| 5,283,390 | A | 2/1994 | Hubis et al. | |
| 5,286,923 | A | 2/1994 | Prudhon et al. | |
| 5,298,680 | A | 3/1994 | Kenny | |
| 5,342,991 | A | 8/1994 | Xu et al. | |
| 5,367,971 | A | 11/1994 | Carpenter et al. | |
| 5,376,758 | A | 12/1994 | Kimber | |
| 5,393,933 | A | 2/1995 | Goertz | |
| 5,399,813 | A | 3/1995 | McNeill et al. | |
| 5,401,908 | A | 3/1995 | Rodeghero | |
| 5,424,491 | A | 6/1995 | Walling et al. | |
| 5,434,354 | A | 7/1995 | Baker et al. | |
| 5,448,669 | A * | 9/1995 | Dunn et al. | 385/101 |
| 5,483,020 | A | 1/1996 | Hardie et al. | |
| 5,493,071 | A | 2/1996 | Newmoyer | |
| 5,514,837 | A | 5/1996 | Kenny et al. | |
| 5,519,173 | A | 5/1996 | Newmoyer et al. | |
| 5,525,757 | A | 6/1996 | O'Brien | |
| 5,541,361 | A | 7/1996 | Friesen et al. | |
| 5,544,270 | A | 8/1996 | Clark et al. | |
| 5,574,250 | A | 11/1996 | Hardie et al. | |
| 5,606,151 | A | 2/1997 | Siekierka et al. | |
| 5,734,126 | A | 3/1998 | Siekierka et al. | |
| 5,742,002 | A | 4/1998 | Arredondo et al. | |
| 5,744,757 | A | 4/1998 | Kenny et al. | |
| 5,767,441 | A | 6/1998 | Brorein et al. | |
| 5,770,820 | A | 6/1998 | Nelson et al. | |
| 5,789,711 | A | 8/1998 | Gaeris et al. | |
| 5,814,768 | A | 9/1998 | Wessels et al. | |
| 5,821,466 | A | 10/1998 | Clark et al. | |
| 5,834,697 | A | 11/1998 | Baker et al. | |
| 5,883,334 | A | 3/1999 | Newmoyer et al. | |
| 5,900,588 | A | 5/1999 | Springer et al. | |
| 5,932,847 | A | 8/1999 | Mayfield | |
| 5,936,205 | A | 8/1999 | Newmoyer | |
| 5,952,607 | A | 9/1999 | Friesen et al. | |
| 5,952,615 | A | 9/1999 | Prudhon | |
| 5,956,445 | A | 9/1999 | Deitz, Sr. et al. | |
| 5,969,295 | A | 10/1999 | Boucino et al. | |
| 5,990,419 | A | 11/1999 | Bogese, II | |
| 6,037,546 | A | 3/2000 | Mottine et al. | |
| 6,064,008 | A | 5/2000 | Craton | |
| 6,066,799 | A | 5/2000 | Nugent | |
| 6,074,503 | A | 6/2000 | Clark et al. | |
| 6,091,025 | A | 7/2000 | Cotter et al. | |
| 6,099,345 | A | 8/2000 | Milner et al. | |
| 6,101,305 | A | 8/2000 | Wagman et al. | |
| 6,139,957 | A | 10/2000 | Craton | |
| 6,140,587 | A | 10/2000 | Sackett | |
| 6,150,612 | A | 11/2000 | Grandy et al. | |
| 6,153,826 | A | 11/2000 | Kenny et al. | |
| 6,162,992 | A | 12/2000 | Clark et al. | |
| 6,194,663 | B1 | 2/2001 | Friesen et al. | |
| 6,211,467 | B1 * | 4/2001 | Berelsman et al. | 174/113 R |
| 6,222,129 | B1 | 4/2001 | Siekierka et al. | |
| 6,222,130 | B1 | 4/2001 | Gareis et al. | |
| 6,239,379 | B1 | 5/2001 | Cotter et al. | |
| 6,248,954 | B1 | 6/2001 | Clark et al. | |
| 6,255,593 | B1 | 7/2001 | Reede | |
| 6,259,031 | B1 * | 7/2001 | Totland et al. | 174/110 R |
| 6,288,340 | B1 | 9/2001 | Arnold | |
| 6,297,454 | B1 | 10/2001 | Gareis | |
| 6,300,573 | B1 * | 10/2001 | Horie et al. | 174/113 R |
| 6,310,295 | B1 | 10/2001 | Despard | |

| | | | | |
|---|---|---|---|---|
| 6,323,427 | B1 | 11/2001 | Rutledge | |
| 6,342,678 | B1 | 1/2002 | Knop et al. | |
| 6,353,177 | B1 | 3/2002 | Young | |
| 6,365,836 | B1 | 4/2002 | Blouin et al. | |
| 6,433,272 | B1 | 8/2002 | Buhler et al. | |
| 6,448,500 | B1 | 9/2002 | Hosaka et al. | |
| 6,452,105 | B2 | 9/2002 | Badii et al. | |
| 6,462,268 | B1 | 10/2002 | Hazy et al. | |
| 6,465,737 | B1 | 10/2002 | Bonato et al. | |
| 6,476,326 | B1 | 11/2002 | Fuzier et al. | |
| 6,506,976 | B1 | 1/2003 | Neveux, Jr. | |
| 6,534,715 | B1 | 3/2003 | Maunder et al. | |
| 6,545,222 | B2 | 4/2003 | Yokokawa et al. | |
| 6,566,605 | B1 | 5/2003 | Prudhon | |
| 6,566,607 | B1 | 5/2003 | Walling | |
| 6,570,095 | B2 | 5/2003 | Clark et al. | |
| 6,573,456 | B2 | 6/2003 | Spruell et al. | |
| 6,596,944 | B1 | 7/2003 | Clark et al. | |
| 6,624,359 | B2 | 9/2003 | Bahlmann et al. | |
| 6,639,152 | B2 | 10/2003 | Glew et al. | |
| 6,687,437 | B1 | 2/2004 | Starnes et al. | |
| 6,710,243 | B2 | 3/2004 | Kao | |
| 6,713,673 | B2 | 3/2004 | Kao | |
| 6,743,983 | B2 | 6/2004 | Wiekhorst et al. | |
| 6,770,819 | B2 | 8/2004 | Patel | |
| 6,787,697 | B2 | 9/2004 | Stipes et al. | |
| 6,800,811 | B1 | 10/2004 | Boucino | |
| 6,812,408 | B2 | 11/2004 | Clark et al. | |
| 6,818,832 | B2 | 11/2004 | Hopkinson et al. | |
| 6,855,889 | B2 | 2/2005 | Gareis | |
| 6,875,928 | B1 | 4/2005 | Hayes et al. | |
| 6,888,070 | B1 | 5/2005 | Prescott | |
| 2001/0001426 | A1 | 5/2001 | Gareis | |
| 2001/0040042 | A1 | 11/2001 | Stipes | |
| 2002/0079126 | A1 | 6/2002 | Valenzuela | |
| 2003/0070831 | A1 | 4/2003 | Hudson | |
| 2003/0106704 | A1* | 6/2003 | Isley et al. | 174/113 R |
| 2003/0121695 | A1 | 7/2003 | Wiebelhaus et al. | |
| 2003/0132021 | A1 | 7/2003 | Gareis | |
| 2003/0205402 | A1 | 11/2003 | Koyasu et al. | |
| 2003/0217863 | A1 | 11/2003 | Clark et al. | |
| 2003/0230427 | A1 | 12/2003 | Gareis | |
| 2004/0035603 | A1 | 2/2004 | Clark et al. | |
| 2004/0050578 | A1 | 3/2004 | Hudson | |
| 2004/0055777 | A1 | 3/2004 | Wiekhorst et al. | |
| 2004/0055779 | A1 | 3/2004 | Wiekhorst et al. | |
| 2004/0055781 | A1 | 3/2004 | Cornibert et al. | |
| 2004/0118593 | A1 | 6/2004 | Augustine et al. | |
| 2004/0149483 | A1 | 8/2004 | Glew | |
| 2004/0149484 | A1* | 8/2004 | Clark | 174/113 R |
| 2004/0256139 | A1 | 12/2004 | Clark | |
| 2005/0023028 | A1 | 2/2005 | Clark | |
| 2005/0029007 | A1 | 2/2005 | Nordin et al. | |
| 2005/0045367 | A1 | 3/2005 | Somers et al. | |
| 2005/0051355 | A1 | 3/2005 | Bricker et al. | |
| 2005/0087360 | A1 | 4/2005 | Speer | |
| 2005/0092514 | A1 | 5/2005 | Kenny et al. | |
| 2005/0092515 | A1 | 5/2005 | Kenny et al. | |
| 2005/0103518 | A1 | 5/2005 | Glew | |
| 2005/0167149 | A1 | 8/2005 | Prescott | |
| 2005/0167151 | A1 | 8/2005 | Kenny et al. | |
| 2005/0189135 | A1 | 9/2005 | Clark | |
| 2005/0199415 | A1 | 9/2005 | Glew | |
| 2005/0205289 | A1 | 9/2005 | Kenny et al. | |

FOREIGN PATENT DOCUMENTS

| | | |
|---|---|---|
| FR | 694100 | 11/1930 |
| GB | 1 390 152 | 4/1975 |
| GB | 2 120 836 A | 12/1983 |
| JP | 06349344 A | 12/1994 |

* cited by examiner

REDUCED ALIEN CROSSTALK ELECTRICAL CABLE WITH FILLER ELEMENT

RELATED APPLICATION

This application is a continuation-in-part of U.S. patent application Ser. No. 11/012,167 to Roger Lique et al., filed on Dec. 16, 2004 now U.S. Pat. No. 7,157,644, the subject matter of which is hereby incorporated by reference.

FIELD OF THE INVENTION

The present invention relates to an electrical cable that reduces alien crosstalk between cables. More specifically, a filler element disposed in the electrical cable reduces alien crosstalk between adjacent cables. Separators provided in each cable reduce crosstalk between the conductors of the cable.

BACKGROUND OF THE INVENTION

Interference between electrical cables bundled together in a cabling system decreases the efficiency of data transmission by the cabling system. Alien near-end crosstalk (ANEXT) and alien far-end crosstalk (AFEXT) noise is caused by the electrical unbalance between the twisted pairs of insulated conductors of adjacent cables. ANEXT and AFEXT are transmission noises that can increase the signal to noise ratio (SNR) and bit error rate (BER) in a cable transmission system, such as for a local area network.

Specifically, ANEXT and AFEXT occur when some of the signal current in a twisted pair of one cable couples with another twisted pair of another cable external to the signal path and along the path of a circuit between the two pairs. That noise corrupts the signal in the twisted pair external to the original signal path. When the circuit between the noise emitting and receiving twisted pairs egresses one cable boundary and crosses another cable boundary, the noise becomes alien crosstalk. Crosstalk also occurs between the twisted pairs of insulated conductors of the cables themselves.

SUMMARY OF THE INVENTION

According to the present invention, there is provided an electrical cable that includes a cable jacket defining a central longitudinal axis and a plurality of twisted pairs of insulated conductors oriented longitudinally within the cable jacket. Each of the twisted pairs of insulated conductors has a width. A filler element is disposed in the cable jacket and is located adjacent to at least one of the twisted pairs of insulated conductors. The filler element defines a width that is substantially larger than the width of each the twisted pairs of insulated conductors. The filler element has a central axis laterally offset from the central longitudinal axis of the cable jacket. The filler element reduces alien crosstalk from an adjacent cable. A is separator disposed in said cable jacket between the twisted pairs of insulated conductors to reduce crosstalk between the twisted pairs of insulated conductors.

The present invention also provides an electrical cable that includes a cable jacket that defines a central longitudinal axis and a substantially non-circular outer perimeter. First, second, third and fourth twisted pairs of insulated conductors are oriented longitudinally within the cable jacket. Each of the twisted pairs of insulated conductors has a width. A filler element is disposed in the cable jacket and located adjacent to at least one of the twisted pairs of insulated conductors. The filler element has a central axis laterally offset from the central longitudinal axis of the cable jacket. The filler element is substantially circular in section transverse to the central axis and defines a diameter that is substantially larger than the width of each the twisted pairs of insulated conductors. The filler element reduces alien crosstalk from an adjacent cable. A separator is disposed in the cable jacket between the first and second twisted pairs of insulated conductors to reduce crosstalk between the twisted pairs of insulated conductors.

The present invention also provides an electrical cable that includes a cable jacket defining a longitudinal axis and a plurality of twisted pairs of insulated conductors oriented longitudinally within the cable jacket. The plurality of twisted pairs of insulated conductors are twisted to form a helix core defining a first lay length. A filler element is disposed in the cable jacket and twisted around the helix core. The filler element defines a second lay length that is larger than the first lay length of the helix core.

Advantages and salient features of the invention will become apparent from the following detailed description, which, taken in conjunction with the annexed drawings, discloses preferred embodiments of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
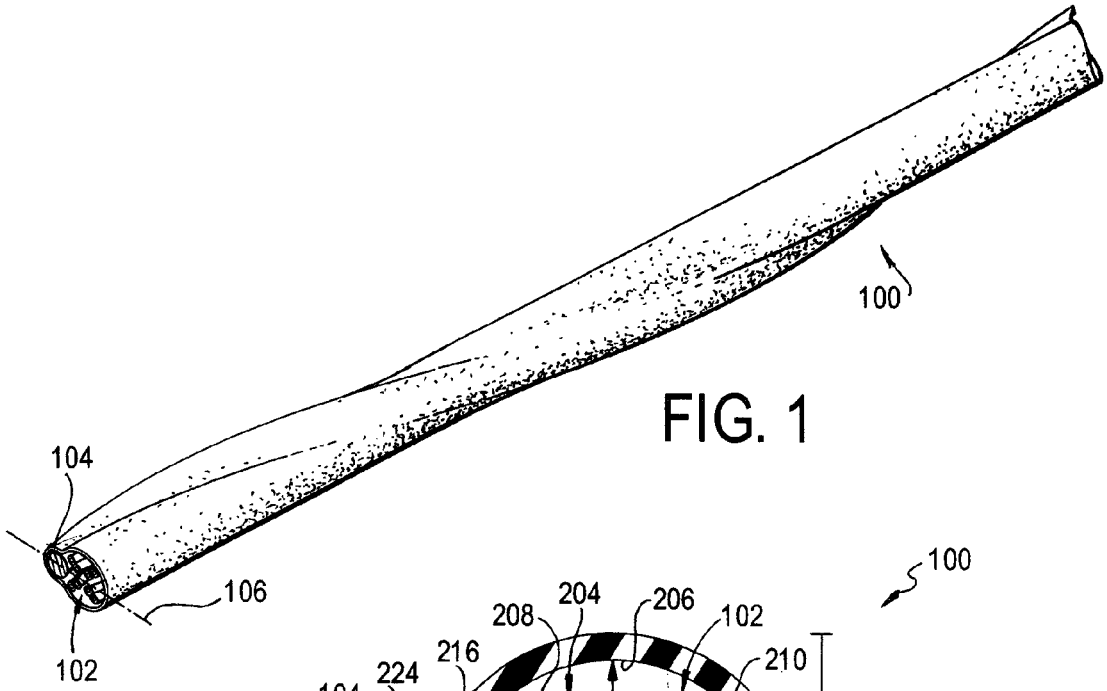
FIG. 1 is a drawing of a perspective view of an electrical cable according to a first embodiment of the present invention.
Figure 2:
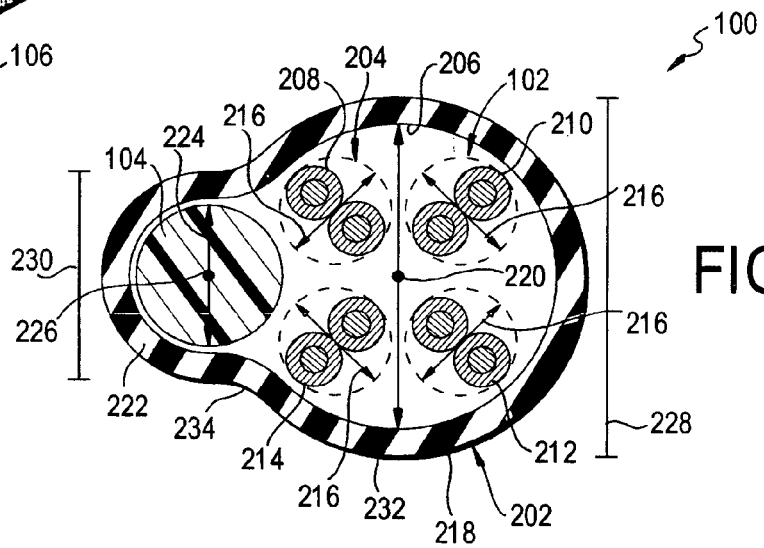
FIG. 2 is a drawing of an elevational view in section of the electrical cable illustrated in FIG. 1, showing a plurality of twisted pairs of insulated conductors and a filler element enclosed by a cable jacket.

Referring to FIGS. 1 and 2, an electrical cable 100 according to a first embodiment of the present invention includes a plurality of twisted pairs of insulated conductors 102 and a filler element 104 for reducing alien crosstalk between adjacent cables. More specifically, the filler element 104 increases the cable diameter along one axis 106 of the cable 100 cross-section, effectively increasing the net distance between the pairs of insulated conductors 102 in the cable 100 from twisted pairs of insulated conductors of an adjacent cable (not shown).

As seen in FIG. 2, the electrical cable 100 has a cable jacket 202 that encloses the filler element 104 and the plurality of twisted pairs of insulated conductors 102 in an inner area 204 defined by the inner perimeter 206 of the cable jacket 202. Although the plurality of twisted pairs of insulated conductors 102 preferably include four pairs of insulated conductors 208, 210, 212, and 214, the electrical cable 100 can include any number of twisted pairs of insulated conductors. The cable jacket 202 can be formed of a dielectric material, such as PVC, TA-910, or polyolefin low smoke zero halogen.

Each twisted pair of insulated conductors 208, 210, 212, and 214 defines a width 216 and is supported in a first region 218 of the cable jacket 202. The cable jacket 202 defines a generally central longitudinal axis 220. The cable 100 can be twisted about the central longitudinal axis 220, as seen in FIG. 1. A second region 222 supports the filler element 104. The filler element 104 has a generally cylindrical rod shape, with a substantially circular cross-sectional shape, and defines a width or diameter 224 and has a central axis 226. The first and second regions 218 and 222 are generally continuous.

The width 228 of the first region 218 is substantially larger than the width 230 of the second region 222, thereby creating an uneven or lopsided outer perimeter 232 of the cable jacket 202, such that the shape of the electrical connector 100 in section transverse to the longitudinal axis 220 is substantially non-circular, as seen in FIG. 2. Preferably, the width 228 of the first region 218 is about twice the width 230 of the second region 222. However, the width 228 of the first region 218 can be any size with respect to width 230 of the second region 222, such as the same as or slightly larger than the width 230 of the second region 222, as long as the first region 218 can accommodate the twisted pairs of insulated conductors 102 and the second region 222 can accommodate the filler element 104. The outer perimeter 232 is asymmetrical and defines a transition area 234 between the larger first region 218 and the smaller second region 222.

The width 224 of the filler element 104 is substantially larger than the width 216 of each of the twisted pairs of insulated conductors 208, 210, 212 and 214. The central axis 226 of the filler element 104 is laterally offset from the central longitudinal axis 220 of the cable 100. By offsetting the axes 220 and 226 of the cable 100 and the filler element 104, respectively, and due to the size of the filler element 104, the diameter of the cable 100 along the axis 106 is increased. Because the width 224 of the filler element 104 is larger than the width 216 of the individual pairs of insulated conductors 208, 210, 212 and 214, the pairs 208, 219, 212 and 214 are prevented from encircling the filler element 104, thereby preventing coaxial alignment of the central axis 226 of the filler element 104 and the central longitudinal axis 220 of the electrical cable 100. Thus the non-circular cross-sectional shape of the electrical cable 100 is maintained. The lopsided shape and the increased diameter along the axis 106 of the electrical cable reduces alien crosstalk between adjacent cables 100 by increasing the distance from the twisted pairs of insulated conductors of the adjacent cables 100.

Although the filler element 104 is preferably shaped as a cylindrical rod, the filler element 104 can have any circular, elliptical or polygonal shape in cross-section. The filler element 104 can be formed of a single material or multiple materials. For example, the filler element 104 can be made of a dielectric material, such as polypropylene, polyolefin insulation, rigid PVC insulation, or low smoke PVC insulation. Alternatively, the filler element 104 can be made of both dielectric and conductive materials. For example, the filler element 104 can be formed with a copper core and any one of FEP insulation or fluoropolymers, low smoke PVC insulation, rigid insulation, polyolefin insulation, or polypropylene insulation.

Figure 3:
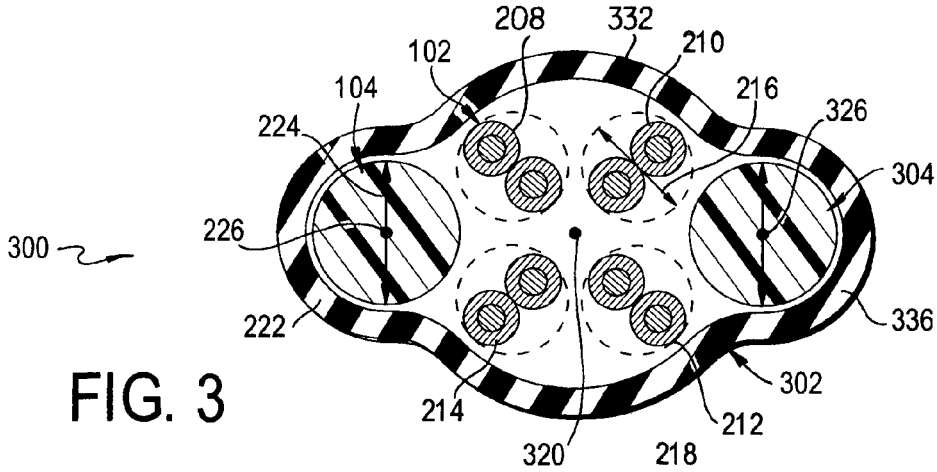
FIG. 3 is a drawing of an elevational view in section of an electrical cable according to a second embodiment of the present invention.

Referring to FIG. 3, an electrical cable 300 in accordance with a second embodiment of the present invention is the same as the electrical cable 100 of the first embodiment, except a second filler element 304 is disposed in a third region 336 of the cable jacket 302. The third region 336 is substantially the same size as the second region 222 and the second filler element 304 is substantially the same size as the first filler element 104. The outer perimeter 332 of the cable jacket 302 is uneven with a non-circular cross-section; however, unlike the first embodiment, the outer perimeter is substantially symmetrical about a vertical axis of FIG. 3. Like the filler element 104, the second filler element 304 has a central axis 326 that is offset from the central longitudinal axis 320 of the cable 300. The second filler element 304 further increases the distance between neighboring cables along axis 106 to reduce alien crosstalk caused by an adjacent cable.

Figure 4:
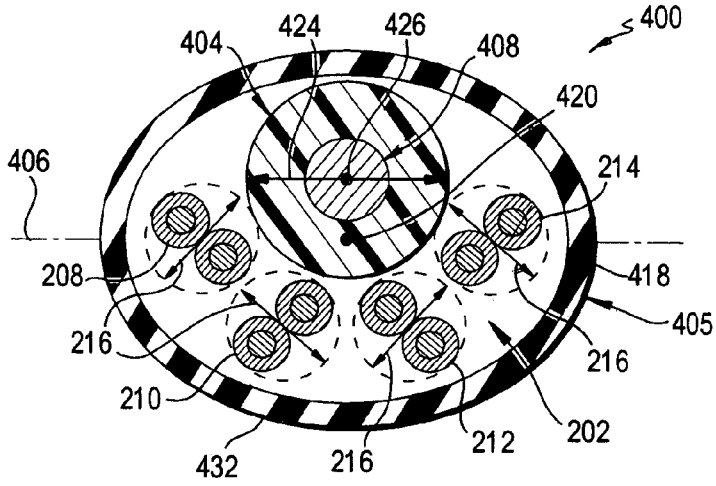
FIG. 4 is a drawing of an elevational view in section of an electrical cable according to a third embodiment of the present invention.

Referring to FIG. 4, an electrical cable 400 in accordance with a fourth embodiment of the present invention includes a filler element 404 and the plurality of twisted pairs of insulated conductors 202 supported in a cable jacket 405. The filler element 404 is similar to the filler element 104, except that it is larger, preferably about twice the width 216 of each twisted pair of insulated conductors 208, 210, 212 and 214. Unlike the cables 100 and 300 of the first and second embodiments, the cable jacket 405 of the cable 400 includes a single region 418 for supporting the filler element 404 and the plurality of twisted pairs 202. The filler element 404 also includes a conductive core 408.

Like the cables 100 and 300 of the first and second embodiments, the cross-sectional shape of the cable 400 is non-circular, such as an elliptical shape. The non-circular shape of the cable 400 defines an even outer perimeter 432 of the cable jacket 406. The non-circular cross-sectional shape of the cable jacket 406 increases the diameter of the cable 400 along one axis 406 of the cable 400. A central axis 426 of the filler element 404 is offset from the central longitudinal axis 420 of the cable 400. Since the width or diameter 424 of the filler element 404 is about twice the width 216 of each twisted pair of insulated conductors 208, 210, 212, and 214, the pairs 208, 210, 212, and 214 are prevented from encircling the filler element 404, so that the filler element 404 remains offset from the central longitudinal axis 420 of the cable 400. Similar to the first and second embodiments, by fashioning the cable 400 in this manner, the distance between twisted pairs of insulated conductors of adjacent cables is increased, thereby reducing alien crosstalk.

Figure 5:
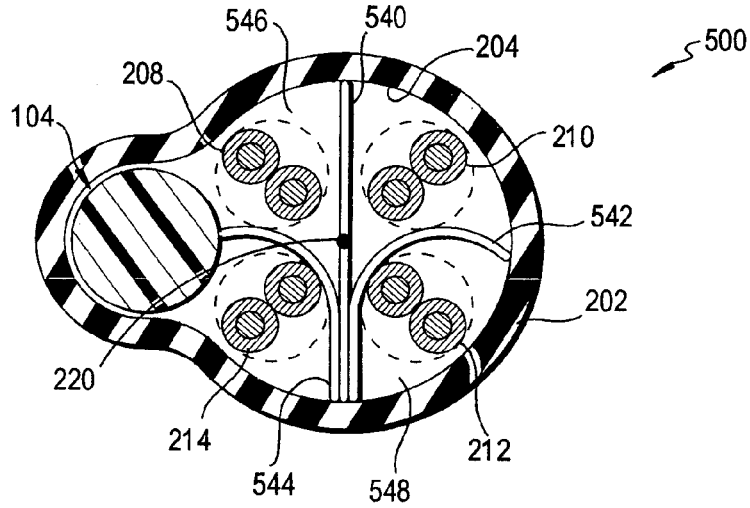
FIG. 5 is a drawing of an elevational view in section of the electrical cable similar to FIG. 2, except a plurality of separators are included to separate the twisted pairs of insulated conductors.
Figure 6:
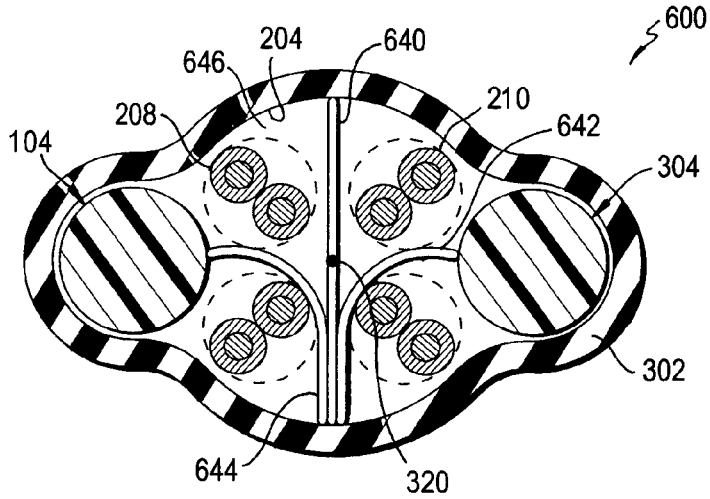
FIG. 6 is a drawing of an elevational view in section of the electrical cable similar to FIG. 3, except a plurality of separators are included to separate the twisted pairs of insulated conductors.

Referring to FIGS. 5 and 6, electrical cables 500 and 600 are the same as the electrical cables 100 and 300 of the first and second embodiments, respectively, except a plurality of separators 540, 542, 544 (FIG. 5) and 640, 642, 644 (FIG. 6) are disposed between the twisted pairs of insulated conductors 208, 210, 212 and 214 to reduce crosstalk between the adjacent pairs. Although three separators are preferably used, any number of separators can be employed including a single separator.

As seen in FIG. 5, the three separators 540, 542, and 544 divide the inner area 204 of the cable 100 into four quadrants with each quadrant supporting one of the twisted pairs of insulated conductors 208, 210, 212 and 214. Likewise, the three separators 640, 642, and 644 divide the inner area 204 of the cable 300. That isolates the twisted pairs 208, 210, 212, and 214 into the four quadrants, thereby isolating the twisted pairs 208, 210, 212, and 214 from each other to reduce crosstalk between the twisted pairs.

Each first separator 540 and 640 is substantially straight and divides the inner area 204 of their respective cables 500 and 600 into first and second halves 546, 646 and 548, 648 with two of the twisted pairs of insulated conductors 208 and 214 being disposed in the first half 546, 646 and the remaining two pairs 210 and 212 being disposed in the second half 548, 648. Each of the second separators 542 and 642 is disposed in the first half 546 and 646 of the respective cables. Similarly, each of the third separators 544 and 644 is disposed in the second half 546 and 646, respectively. Each second separator 542 and 642 divides twisted pairs 208 and 214 and each third separator 544 and 644 divides twisted pairs 210 and 212. The separators 540, 542, 544 and 640, 642, 644 are preferably formed of a polymer material, such as solid or foamed polymer tape. The separators 540, 542, 544 and 640, 642, 644 are similar to the three separator tapes disclosed in co-pending commonly owned U.S. patent application Ser. No. 11/012,149 to Lique et al., filed Dec. 16, 2004, and entitled Reduced Alien Crosstalk Electrical Cable, the subject matter of which is herein incorporated by reference.

Figures 7A, 7B:
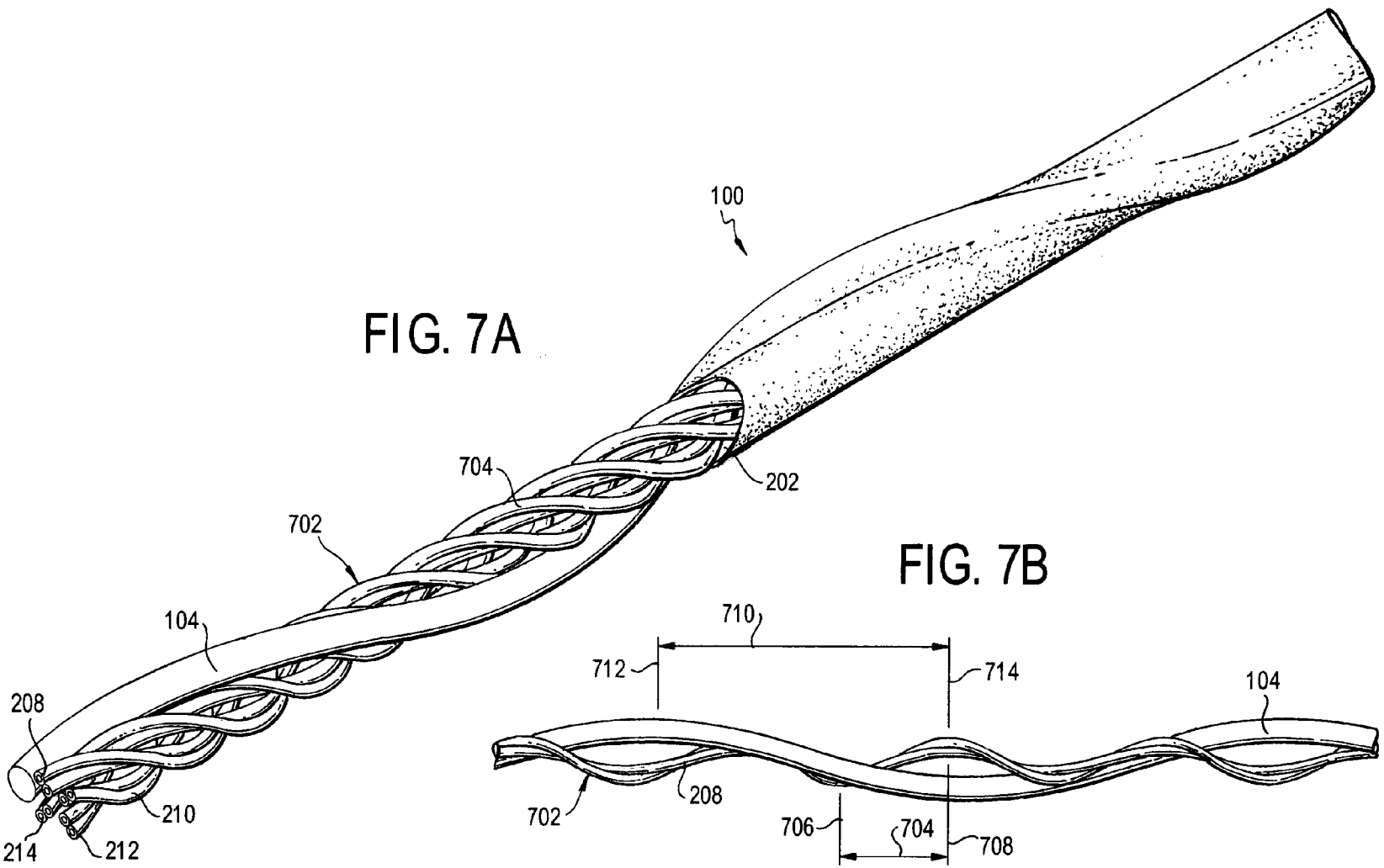
FIG. 7A is a drawing of a perspective view of the electrical cable in accordance with the embodiments of the invention, showing the twisted core and filler element of the cable.
FIG. 7B is a drawing of a twisted pair of insulated conductors and a twisted filler element of the cable illustrated in FIG. 7A, showing the different lay lengths of the twisted pair of insulated conductors and the filler element.

Referring to FIGS. 7A and 7B, each of the embodiments of the cables described above are preferably twisted in such a manner as to prevent the filler element from entwining with the twisted pairs of insulated conductors 208, 210, 212 and 214. For example, the twisted pairs of insulated conductors 208, 210, 212, 214 within the cable jacket 202 of the cable 100 are twisted together generally about the axis 220 (FIG. 2) to form a twisted or helix core 702. Separators similar to separators 540, 542, 544, 640, 642 and 644 can also be provided between the twisted pairs of insulated conductors 208, 210, 212, 214 and twisted with the pairs as part of the helix core 702. The filler element 104 is twisted around the helix core 702.

Figure 7C:
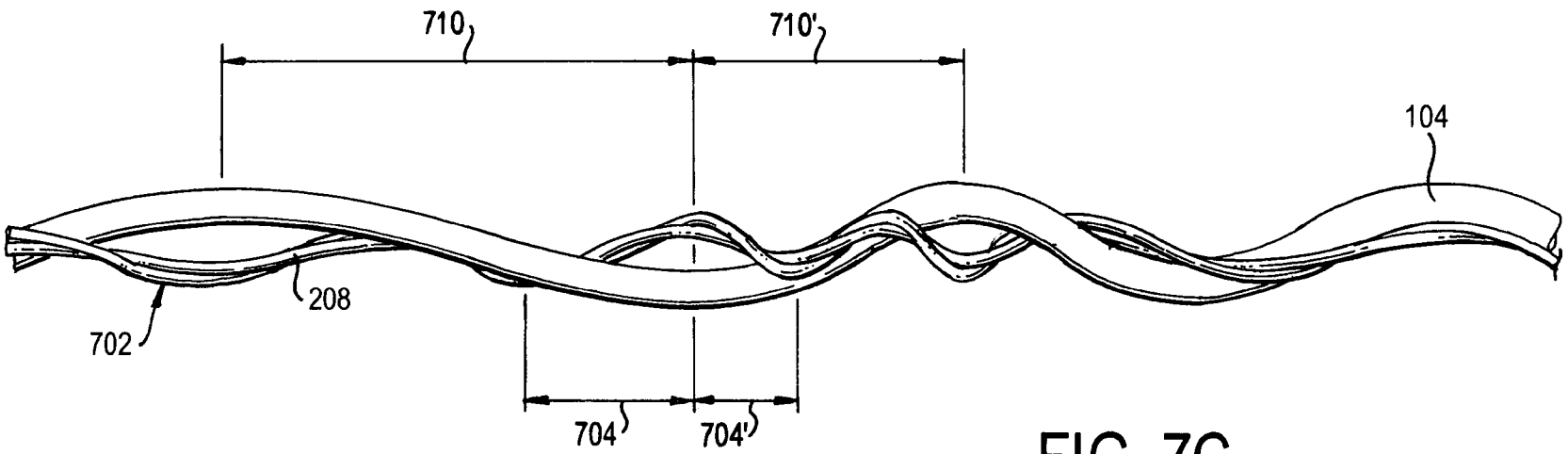
FIG. 7C is a drawing of a twisted pair of insulated conductors and a filler element of the cable illustrated in FIG. 7A, showing the lay lengths of the twisted pair of insulated conductors and the filler element changing along the length of the cable.

The helix core 702 defines a core lay length 704 between a first apex 706 and a second apex 708, as seen in FIG. 7B (showing a single twisted pair of insulated conductors 208 representing the helix core 702). Similarly, the filler element 104 defines a filler lay length 710 defined between a first apex 712 of the filler element 104 and a second apex 714. The filler lay length 710 is larger than the core lay length 704 to prevent the filler element 104 from meshing or entwining with the helix core 702. Preferably, the filler lay length 710 is substantially larger than the core lay length 704. For example, the core lay length 704 can be about 1.5-3 inches and the filler lay length 710 can be about 2.5-4 inches. Each of the core lay length 704 and the filler lay length 710 can vary along the length of the cable, as seen in FIG. 7C, showing a core lay length 704' and a filler lay length 710' different than core lay length 704 and filler lay length 710, respectively. In order to substantially simultaneously twist both the pairs 208, 210, 212, and 214 and the filler element 104 and also maintain a larger filler lay length 710 than the core lay length 704, a traverse (not shown) is added to the conventional machine for twisting cable. The traverse moves the filler element 104 back and forth as the core 702 is being twisted. Moving the filler element 104 back and forth ensures that the pairs 208, 210, 212 and 214 are twisted together and that the filler element 104 twists around the pairs, thereby creating a larger lay length 710 of the filler element 104. By preventing the filler element 104 from entwining with the twisted pairs of insulated conductors 208, 210, 212 and 214, the filler element 104 remains on the outside of the pairs, thereby maintaining a sufficient distance between adjacent cables to reduce alien crosstalk.

While particular embodiments have been chosen to illustrate the invention, it will be understood by those skilled in the art that various changes and modifications can be made therein without departing from the scope of the invention as defined in the appended claims. For example, any number of filler elements can be employed with the cable including one, two, or more than two filler elements.

What is claimed is:

1. An electrical cable, comprising:

a cable jacket defining a central longitudinal axis;

a plurality of twisted pairs of insulated conductors oriented longitudinally within said cable jacket, each of said twisted pairs of insulated conductors defining a width;

a filler element disposed in said cable jacket and located adjacent to at least one of said twisted pairs of insulated conductors and a portion of said cable jacket, a space between said portion of said cable jacket and said filler element being devoid of any twisted pairs of insulated conductors, said filler element defining a width that is substantially larger than said width of each said twisted pairs of insulated conductors, and said filler element having a central axis laterally offset from said central longitudinal axis of said cable jacket, said filler element reduces alien crosstalk from an adjacent cable; and at least one separator disposed in said cable jacket between said twisted pairs of insulated conductors to reduce crosstalk between said twisted pairs of insulated conductors.

2. An electrical cable according to claim 1, wherein said plurality of twisted pairs of insulated conductors include first, second, third and fourth twisted pairs of insulated conductors; and said separator is disposed between said first and second twisted pairs of insulated conductors.

3. An electrical cable according to claim 2, wherein a second separator is disposed in said cable jacket between said second and third twisted pairs of insulated conductors.

4. An electrical cable according to claim 3, wherein a third separator is disposed in said cable jacket between said first and fourth twisted pairs of insulated conductors.

5. An electrical cable according to claim 1, wherein said separator is either substantially straight or substantially curved.

6. An electrical cable according to claim 1, wherein said cable jacket defines an outer perimeter that is substantially non-circular in section transverse to said central longitudinal axis.

7. An electrical cable according to claim 1, wherein
a second filler element is disposed in said cable jacket;
said second filler element has a central axis laterally offset from said central longitudinal axis of said cable jacket; and
said second filler element defines a width that is substantially larger than said width of each of said twisted pairs of insulated conductors.

8. An electrical cable according to claim 1, wherein
said width of said filler element is about twice said width of each of said plurality of twisted pairs of insulated conductors.

9. An electrical cable, comprising:
a cable jacket defining a central longitudinal axis and a substantially non-circular outer perimeter;
first, second, third and fourth twisted pairs of insulated conductors oriented longitudinally within said cable jacket, each of said insulated conductors defining a width;
a filler element disposed in said cable jacket and located adjacent to at least one of said twisted pairs of insulated conductors, said filler element having a central axis laterally offset from said central longitudinal axis of said cable jacket, said filler element being substantially circular in section transverse to said central axis and defining a diameter that is larger than said width of each said insulated conductors, said filler element reduces alien crosstalk from an adjacent cable, said first, second, third and fourth twisted pairs of insulated conductors being twisted together and said filler element being twisted around said first, second, third and fourth twisted pairs of insulated conductor, and twist lay lengths of said first, second, third and fourth twisted pairs of insulated conductors and said filler element changing along a length of the cable; and
a first separator disposed in said cable jacket between said first and second twisted pairs of insulated conductors to reduce crosstalk between said twisted pairs of insulated conductors.

10. An electrical cable according to claim 9, wherein
a second separator is disposed in said cable jacket between said second and third twisted pairs of insulated conductors; and
a third separator is disposed in said cable jacket between said first and fourth twisted pairs of insulated conductors.

11. An electrical cable according to claim 10, wherein
said first separator is substantially straight; and
each of said second and third separators is substantially curved.

12. An electrical cable according to claim 10, wherein
each of said first, second, and third separators is made of polymeric tape.

13. An electrical cable according to claim 9, wherein
said outer perimeter is substantially uneven.

14. An electrical cable according to claim 9, wherein
said cable jacket includes first and second regions;
said first region supports said first, second, third and fourth twisted pairs of insulated conductors and said second region supports said filler element; and
said first region is substantially larger than said second region.

15. An electrical cable according to claim 9, wherein
said filler element is made of a dielectric material.

16. An electrical cable according to claim 9, wherein
said filler element includes a conductive core.

17. An electrical cable, comprising:
a cable jacket defining a length and a longitudinal axis along the length;
a plurality of twisted pairs of insulated conductors oriented longitudinally within said cable jacket, said plurality of twisted pairs of insulated conductors being twisted to form a helix core defining a first lay length; and
a filler element disposed in said cable jacket and twisted around said helix core so that said filler element is disposed in a space between said cable jacket and said helix core with no twisted pairs of insulated conductors being located in said space, said filler element defining a second lay length that is different than said first lay length of said helix core.

18. An electrical cable according to claim 17, wherein
said filler element defines a width that is substantially larger than a width defined by each of said insulated conductors.

19. An electrical cable, comprising:
a cable jacket having a longitudinal axis;
a plurality of twisted pairs of insulated conductors oriented longitudinally within said cable jacket; and
first, second, and third separators disposed between said plurality of twisted pairs of insulated conductors, each of said first, second, and third separators including opposite first and second ends,
said first separator being substantially straight and dividing said cable jacket into first and second halves,
said second separator being substantially curved and located in said first half with at least one of said plurality of twisted pairs of conductors being located between the first and second separators,
said third separator being substantially curved and located in said second half with at least one of said plurality of twisted pairs of conductors being located between the first and third separators, and
and said first ends of said first, second, and third separators meeting one another so that said first ends are adjacent one another with no twisted pairs of conductors disposed therebetween.

20. An electrical cable, comprising:
a cable jacket defining a central longitudinal axis;
a plurality of twisted pairs of insulated conductors oriented longitudinally within said cable jacket, each of said insulated conductors defining a width;
a filler element disposed in said cable jacket and located adjacent to at least one of said twisted pairs of insulated conductors, said filler element defining a width that is larger than said width of each said insulated conductors, and said filler element having a central axis laterally offset from said central longitudinal axis of said cable jacket, said filler element reduces alien crosstalk from an adjacent cable, said plurality of twisted pairs of insulated conductors including at least three twisted pairs of insulated conductors forming a core, and said filler element being twisted around said core; and
at least one separator disposed in said cable jacket between said twisted pairs of insulated conductors to reduce crosstalk between said twisted pairs of insulated conductors.

21. An electrical cable according to claim 20, wherein
said plurality of twisted pairs of insulated conductors include first, second, third and fourth twisted pairs of insulated conductors; and said separator is disposed between said first and second twisted pairs of insulated conductors.

22. An electrical cable according to claim 21, wherein a second separator is disposed in said cable jacket between said second and third twisted pairs of insulated conductors.

23. An electrical cable according to claim 22, wherein a third separator is disposed in said cable jacket between said first and fourth twisted pairs of insulated conductors.

24. An electrical cable according to claim 20, wherein said separator is either substantially straight or substantially curved.

25. An electrical cable according to claim 20, wherein said cable jacket defines an outer perimeter that is substantially non-circular in section transverse to said central longitudinal axis.

26. An electrical cable according to claim 20, wherein a second filler element is disposed in said cable jacket;

said second filler element has a central axis laterally offset from said central longitudinal axis of said cable jacket; and said second filler element defines a width that is larger than said width of each of said insulated conductors.

27. An electrical cable according to claim 20, wherein said width of said filler element is about twice said width of each of said of insulated conductors.

28. An electrical cable according to claim 20, wherein at least a portion of said filler element is formed of a conductive material.

29. An electrical cable, comprising:

a cable jacket defining a central longitudinal axis and a substantially non-circular outer perimeter;

a plurality of twisted pairs of insulated conductors oriented longitudinally within said cable jacket;

a filler element disposed in said cable jacket and located adjacent to at least one of said twisted pairs of insulated conductors, said filler element having a central axis laterally offset from said central longitudinal axis of said cable jacket, said filler element being substantially circular in section transverse to said central axis, said filler element reduces alien crosstalk from an adjacent cable, said plurality of twisted pairs of insulated conductors being twisted together and said filler element being twisted around said plurality of twisted pairs of insulated conductor, and twist lay lengths of plurality of twisted pairs of insulated conductors and said filler element changing along a length of the cable; and at least one separator being disposed in said cable jacket between said plurality of twisted pairs of insulated conductors to reduce crosstalk between said plurality of twisted pairs of insulated conductors.

30. An electrical cable according to claim 29, wherein said lay length of said filler element is different that said lay length of said plurality of twisted pairs of insulated conductors.

31. An electrical cable according to claim 29, wherein said outer perimeter of said cable jacket is uneven.

32. An electrical cable according to claim 29, wherein said filler element is formed of a dielectric material.

33. An electrical cable according to claim 29, wherein a portion of said filler element is formed of metal.

34. An electrical cable, comprising:

a cable jacket defining a central longitudinal axis and a substantially non-circular outer perimeter;

a plurality of twisted pairs of insulated conductors oriented longitudinally within said cable jacket; and a filler element disposed in said cable jacket and located adjacent to at least one of said twisted pairs of insulated conductors, said filler element having a central axis laterally offset from said central longitudinal axis of said cable jacket, said filler element being substantially circular in section transverse to said central axis, said filler element reduces alien crosstalk from an adjacent cable, said plurality of twisted pairs of insulated conductors being twisted together and said filler element being twisted around said plurality of twisted pairs of insulated conductor, and twist lay lengths of plurality of twisted pairs of insulated conductors and said filler element changing along a length of the cable.

35. An electrical cable, comprising:

a cable jacket defining a central longitudinal axis;

a plurality of twisted pairs of insulated conductors including first, second, third and fourth twisted pairs of insulated conductors oriented longitudinally within said cable jacket, each of said insulated conductors defining a width;

a filler element disposed in said cable jacket and located adjacent to at least one of said twisted pairs of insulated conductors, said filler element defining a width that is larger than said width of each said insulated conductors, and said filler element having a central axis laterally offset from said central longitudinal axis of said cable jacket, said filler element reduces alien crosstalk from an adjacent cable;

a first separator disposed in said cable jacket between said first and second twisted pairs of insulated conductors to reduce crosstalk between said twisted pairs of insulated conductors;

a second separator disposed in said cable jacket between said second and third twisted pairs of insulated conductors; and a third separator disposed in said cable jacket between said first and fourth twisted pairs of insulated conductors.

36. An electrical cable, comprising:

a cable jacket defining a central longitudinal axis;

a plurality of twisted pairs of insulated conductors oriented longitudinally within said cable jacket, each of said insulated conductors defining a width;

a filler element disposed in said cable jacket and located adjacent to at least one of said twisted pairs of insulated conductors, said filler element defining a width that is larger than said width of each said insulated conductors, and said filler element having a central axis laterally offset from said central longitudinal axis of said cable jacket, said filler element reduces alien crosstalk from an adjacent cable; and at least one separator disposed in said cable jacket between said twisted pairs of insulated conductors to reduce crosstalk between said twisted pairs of insulated conductors, said separator being either substantially straight or substantially curved.

37. An electrical cable, comprising:

a cable jacket defining a central longitudinal axis;

first, second, third and fourth twisted pairs of insulated conductors oriented longitudinally within said cable jacket, each of said twisted pairs of insulated conductors defining a width;

a filler element disposed in said cable jacket and located adjacent to at least one of said twisted pairs of insulated conductors, said filler element defining a width that is substantially larger than said width of each said twisted pairs of insulated conductors, and said filler element having a central axis laterally offset from said central longitudinal axis of said cable jacket, said filler element reduces alien crosstalk from an adjacent cable;

at least one separator disposed in said cable jacket between said first and second twisted pairs of insulated conductors to reduce crosstalk between said twisted pairs of insulated conductors; and a second separator disposed in said cable jacket between said second and third twisted pairs of insulated conductors.

38. An electrical cable, comprising:

a cable jacket defining a central longitudinal axis;

a plurality of twisted pairs of insulated conductors oriented longitudinally within said cable jacket, each of said twisted pairs of insulated conductors defining a width;

a filler element disposed in said cable jacket and located adjacent to at least one of said twisted pairs of insulated conductors, said filler element defining a width that is substantially larger than said width of each said twisted pairs of insulated conductors, and said filler element having a central axis laterally offset from said central longitudinal axis of said cable jacket, said filler element reduces alien crosstalk from an adjacent cable; and at least one separator disposed in said cable jacket between said twisted pairs of insulated conductors to reduce crosstalk between said twisted pairs of insulated conductors, wherein said separator is either substantially straight or substantially curved.

* * * * *

UNITED STATES PATENT AND TRADEMARK OFFICE

CERTIFICATE OF CORRECTION

PATENT NO. : 7,238,885 B2
APPLICATION NO. : 11/087571
DATED : July 3, 2007
INVENTOR(S) : Roger Lique et al.

It is certified that error appears in the above-identified patent and that said Letters Patent is hereby corrected as shown below:

On the Title Page Item (57), column 2, line 8, change: "is substantially larger than the width of each the twisted pairs" to -- is substantially larger than the width of each of the twisted pairs --

Col. 1, line 54, change: "is substantially larger than the width of each the twisted pairs." to -- is substantially larger than the width of each of the twisted pairs. --

Col. 1, line 58, change: "adjacent cable. A is separator disposed in said cable jacket." to -- adjacent cable. A separator is disposed in said cable jacket. --

Col. 2, Line 6, change: "substantially larger than the width of each the twisted pairs." to -- substantially larger than the width of each of the twisted pairs. --

Col. 3, line 63, change: "conductors 208, 210, 212 and 214, the pairs 208, 219, 212" to -- conductors 208, 210, 212 and 214, the pairs 208, 210, 212 --

Col. 7, line 32, change: "twisted pairs of insulated conductor, and twist lay" to -- twisted pairs of insulated conductors, and twist lay --

Col. 8, line 39, change: "and said first ends of said first, second, and third separa-" to -- said first ends of said first, second, and third separa- --

Col. 9, line 46, change: "insulated conductor, and twist lay lengths of plurality of" to --insulated conductors, and twist lay lengths of plurality of --

Signed and Sealed this

Twelfth Day of August, 2008

JON W. DUDAS
*Director of the United States Patent and Trademark Office*